US006984780B2

(12) United States Patent
Reierson

(10) Patent No.: US 6,984,780 B2
(45) Date of Patent: Jan. 10, 2006

(54) STRINGED INSTRUMENT FINGERBOARD WITH POSITION MARKERS

(76) Inventor: Timothy D. Reierson, 6604 Appleview Rd., Yakima, WA (US) 98908

( * ) Notice: Subject to any disclaimer, the term of this patent is extended or adjusted under 35 U.S.C. 154(b) by 151 days.

(21) Appl. No.: 10/625,446

(22) Filed: Jul. 22, 2003

(65) Prior Publication Data

US 2005/0016353 A1 Jan. 27, 2005

(51) Int. Cl.
*G10D 3/06* (2006.01)

(52) U.S. Cl. ..... 84/314 R; 84/291; 84/293

(58) Field of Classification Search ..... 84/314 R, 84/291, 293
See application file for complete search history.

(56) References Cited

U.S. PATENT DOCUMENTS

| | | | | | |
|---|---|---|---|---|---|
| 1,692,207 | A | * | 11/1928 | Hall | 84/314 R |
| 1,699,380 | A | * | 1/1929 | Stewart | 84/314 R |
| 2,788,699 | A | | 4/1957 | Pipkin | 84/470 R |
| 3,403,591 | A | | 10/1968 | Weitzner | 84/485 R |
| 3,845,686 | A | | 11/1974 | Salvo | 84/485 R |
| 3,854,370 | A | | 12/1974 | Sapinski | 84/485 R |
| 3,943,815 | A | | 3/1976 | Gilbert | 84/293 |
| 3,978,756 | A | | 9/1976 | Feldman | 84/470 R |
| 3,978,757 | A | | 9/1976 | Johnson | 84/485 R |
| 4,080,867 | A | | 3/1978 | Ratanangsu | 84/477 R |
| 4,286,495 | A | | 9/1981 | Roof | 84/485 R |
| 4,807,509 | A | | 2/1989 | Graham | 84/314 R |
| 5,063,818 | A | | 11/1991 | Salazar | 84/314 R |
| 5,398,585 | A | | 3/1995 | Starr | 84/646 |
| 5,557,057 | A | | 9/1996 | Starr | 84/617 |
| 5,920,023 | A | | 7/1999 | Ravagni et al. | 84/485 |
| 5,977,462 | A | * | 11/1999 | Wolfson | 84/267 |

OTHER PUBLICATIONS www.xs4all.nl/~huygensf/doc/terpgit.html (Jul. 28, 2003) Terpstra.

* cited by examiner

*Primary Examiner*—Shih-Yung Hsieh
(74) *Attorney, Agent, or Firm*—Stratton Ballew PLLC

(57) ABSTRACT

A stringed instrument fingerboard with position markers for the improved recognition of notes, scales, chords, positions, intervals, and, fingering patterns. The array of position markers is an orderly arrangement of position markers on the fingerboard, in which each position marker of the array is located in one-to-one correspondence with a string for referencing notes. The array of position markers may correspond to a multiplicity of orderly arrangements of position markers on the fingerboard. The position markers of an array may have variations in user discernable characteristics, such as shape, size, color, or design. The position markers are permanently affixed to the fingerboard, providing permanent note-references for all notes, all, scales, and all chords. Improved note recognition is also achieved by the musician employing the array of position markers. An alternative embodiment includes a reference diagram, displaying the apparatus in diagram form. The reference diagram enhances a musician's use of conventional music, reference materials for stringed instruments.

15 Claims, 9 Drawing Sheets

STRINGED INSTRUMENT FINGERBOARD WITH POSITION MARKERS

TECHNICAL FIELD

The present invention relates to a fingerboard with an array of fingerboard position markers, for a stringed musical instrument and more particularly to an orderly arrangement of fingerboard position markers, where each position marker is located in one-to-one correspondence with a string for improved note recognition.

BACKGROUND OF THE INVENTION

For the purposes of the present invention, "stringed instruments" are those stringed musical instruments that have strings extending over a fingerboard, the strings attach at both ends to the instrument, vibrating to create sound, and which are played by use of or in reference to the fingerboard.

There are many different stringed instruments that are played by use of or in reference to a fingerboard. Some examples include, but are not limited to: bass guitar, guitar, steel guitar, dobro, lute, mandolin, mandola, sitar, banjo, ukulele and instruments of the violin family. These stringed instruments may be electric or acoustic.

For such stringed instruments, the player's fingers stop the strings at the appropriate locations on the fingerboard to produce the desired notes while plucking or bowing the corresponding string or strings. The string or strings may also be stopped using an object such as a metal bar, bottle or slide. Steel guitar and slide guitar are examples of stringed instruments which are played using this technique. Fretted instruments have raised ribs, known as frets, which protrude from the fingerboard, transverse to the strings. The frets are typically spaced in a predetermined fashion, such that when one of the strings is depressed, it may be stopped along its length against the fret, usually at an interval of a "half-note," which is also referred to as a half-step or a half-tone. Conventionally, frets are numbered beginning at the nut. The 1st fret is the fret adjacent to the nut. The next fret is the 2nd fret, then the 3rd fret, and so on. The numbering of the frets continues in similar manner along the length of the fingerboard. Conventional fretted instruments have half-note fret intervals others have fret intervals corresponding to a major scale or other arrangement of note intervals. The term "fret-space" as used herein, refers to the area on the fingerboard immediately adjacent to a fret. Conventionally, the numbering of the fret-spaces begins at the nut. The 1st fret-space is the area between the nut and the 1st fret. The 2nd fret-space refers to the area between the 1st and 2nd frets, and so on.

Many players of stringed instruments have difficulties due to the lack of effective visual note references on the fingerboard of their instruments. An unmarked fingerboard provides the most difficulty for note reference, because it offers a minimum of visual cues for locating notes. Past attempts to remedy this problem typically employed marks on the fingerboard for providing visual references. These existing fingerboard marking approaches can be described as having two characteristics, which are the location of mark, referred to herein as "mark-location," and the type of mark, referred to herein as "mark-type." The mark-location characteristics are subdivided into either "fret-space-referencing" or "note-referencing." Specifically, a fret-space-referencing mark is located anywhere within a fret-space. It follows that a fret-space-referencing mark is independent of string location. For example, a mark located between the sixth and seventh frets without regard to string location is a fret-space-referencing mark. A note-referencing mark is also located within a fret-space, but must be located in one-to-one correspondence with a string. It follows that an individual note-referencing mark is located at an individual note. For example, a decal marking the note "C" location is a note-referencing mark. The mark-type characteristic is subdivided into either "permanent" or "impermanent." A permanent mark is affixed permanently to the fingerboard. For example, a mark embedded in the fingerboard as an inlay is a mark-type commonly practiced in the industry. In contrast, an impermanent mark is attached or displayed temporarily or removably on the fingerboard. For example, a changing display of lights on the fingerboard or removable decals are impermanent marks.

Presently, a standard, permanent fingerboard mark known as a "position marker" is often employed. The position marker is typically embedded permanently in the fingerboard as an inlay, or permanently affixed to the fingerboard by painting a mark onto the fingerboard surface. Position markers are placed flush with the fingerboard surface and are clearly visible in contrast to the fingerboard. Position markers are a component part of the fingerboard, typically fastened or applied to the fingerboard in the manufacturing process of the stringed instrument. A position marker is characterized by type as permanent.

There also presently exists a standard system of fingerboard markings, referred to herein as the "conventional arrangement of position markers." This system uses position markers as defined above. In the conventional arrangement of position markers, marks are permanently located on the fingerboard within fret-spaces, and the marks are independent of string location. With the conventional arrangement of position markers the mark-location is fret-space-referencing and the mark-type is permanent.

The conventional arrangement of position markers on a fingerboard consists of position markers located within selected fret-spaces. Typically, these position markers are in the shape of circles. However, such position markers may be other shapes and may be a variety of sizes, colors, and designs. Also typically, conventional position markers are placed so that any single position marker is centered within a particular fret-space location. However, in some cases, the position markers are somewhat offset from the center of the fret-space. The most complete conventional arrangement of position markers typically includes single, circle shaped fret-space-referencing markers at the 3rd, 5th, 7th, 9th, 15th, 17th, 19th, and 21st fret-spaces. Additionally, the conventional arrangement of position markers can include two circle shaped marks at the 12th fret-space and the 24th fret-space. Typical variations include markings at the 3rd, 5th, 7th, 9th, and 12th fret-spaces only; markings at the 5th and 12th fret-spaces only; and markings at the 10th instead of the 9th fret-space location.

This conventional arrangement of position markers has two distinct advantages: It is permanent, and it is in widespread use as a standard. However, a disadvantage of the conventional arrangement of position markers is that for each marked fret-space location, many different notes are present, one corresponding note for each string. The player then uses knowledge of the open string tuning in relation to the fret-space location to play the desired note. For example, consider the open tuned strings E, A, D, and G, as for the electric bass guitar, with a position marker at the 5th fret-space. For the E string, the position marker corresponds to the A note. For the A string, the same position marker corresponds to the D note. For the D string, the same position marker corresponds to the G note. For the G string, the same position marker corresponds to the C note. This ambiguity is a major difficulty in the playing of stringed instruments.

To help overcome the above-described difficulties, certain instructional materials and methods include, decals to be placed on the fingerboard. These training aids are impermanent, and removed from the instrument after the notes are learned. They do not provide a continuing reference needed for the playing of stringed instruments. These approaches rely on repetition and memorization to recognize note locations, usually retaining the conventional arrangement of position markers on the instrument to assist in referencing fret-space locations. In these approaches the mark-location is note-referencing and the mark-type is impermanent.

The many problems and difficulties of learning to play stringed instruments have been discussed in previous U.S. patents. Examples of such patents include U.S. Pat. No. 4,807,509, issued to John F. Graham and entitled "Electroluminescent Fret Grid for Stringed Instruments," and U.S. Pat. No. 4,286,495 issued to John Roof and entitled "Musical Instrument Training Device." The Graham '509 patent offers a musical training device as a possible solution to the above-described problems by providing an easily viewable matrix of thin lights displayed within the fret board of a guitar and having a wide angle viewing area under ambient lighting conditions. The Graham '509 patent offers the ability to display note, scale or chord locations through visual means by activating lights or by displaying alphabetic characters representing actual note, scale or chord names.

The Roof '495 patent is also offered as an electrical musical training device which provides a fret board lighting system for displaying pre-determined chord note locations and indicating the corresponding strings to be played. The Roof '495 patent includes means to sequentially indicate multiple chord patterns for the purpose of student practice.

The Graham '509 and the Roof '495 patents offer a tool for improving playing skills by displaying a pre-selected grouping of notes, such as the notes of a particular scale, or chord, or all of the locations of a particular note. One application of these inventions would be to indicate, through lighting, all the note locations of a particular scale which has been pre-programmed for the device. Then, by stopping the strings only at the lighted fret-space locations, an individual could play the correct notes of that scale. They provide fingerboard marks via lighting indicators, where the lighted fingering locations are in one-to-one correspondence to the fingering locations of particular notes, scales or chords. The Graham '509 and Roof '495 patents are intended as teaching aids for use as follows: a player will learn a particular note, scale or chord by stopping strings at the lighted, fret-space locations; then the player will learn to play the note, scale or chord with the lighting indicators turned off.

Therefore, in the Graham '509 and Roof '495 patents the mark-location is note-referencing and the mark-type is impermanent. A disadvantage is that both patents require special construction involving electrical power supply, electronic circuitry, and intricate visual display apparatuses. After the lights are turned off, a disadvantage is that these patents do not provide any continuing visual references for playing the instrument. Therefore, the stringed instruments using these patents usually retain position markers in the conventional arrangement of position markers to assist in referencing fret-space locations. Another disadvantage is that potentially many different pre-programmed settings would be required to display the great variety of notes, scales or chords. It is a further disadvantage to leave the lighting display on because in many playing situations the user will find that changing the lighting display to correspond to the music will be cumbersome.

U.S. Pat. No. 1,699,380 to Stewart describes an improvement to stringed musical instruments with a plurality of contrasting characters on the fingerboard to indicate fingering positions for specific chords. The characters indicating chords may be printed on the fingerboard, applied using gummed labels, pasted to the fingerboard or removable chord diagrams secured to the fingerboard. The characters indicating chords may be colored celluloid dots inset or countersunk in the fingerboard.

Therefore, in this approach the mark-location for chords is note-referencing and the mark-type is either impermanent or permanent, depending on materials and fingerboard application methods. The note-referencing chord characters are beneficial to learning a given chord. The impermanent type chord characters are removed after the chord is learned. After removal, a disadvantage is that the Stewart patent does not provide any continuing visual references for playing the instrument. If not removed, a disadvantage is that the chord characters will conflict with a variety of other chords. This would cause visual confusion and is not suitable for most playing situations. The permanent type chord characters are also not suitable for general playing situations because the chord characters will conflict with a variety of other chords, and have the further disadvantage that the chord characters are not removable.

U.S. Pat. No. 5,920,023 to Ravagni et al. describes a device for teaching students of stringed instruments note locations and proper finger placement on the fingerboard of the instrument. The device comprises a sheet of autogenously adhesive plastic on which is printed a variety of marks indicating note locations, scales or chords for finger placement. The sheet is wrapped around the fingerboard and neck of the instrument. The sheet adheres to itself, and is removable from the instrument.

Therefore, in this approach the mark-location is note-referencing and the mark-type is impermanent. The note-referencing marks are beneficial to learning a given note, scale or chord. If not removed, a disadvantage is that the marks will conflict with a variety of other notes, scales or chords. This would cause visual confusion and is not suitable for most playing situations. The impermanent type marks are removed after the notes, scales or chords are learned. After removal, a disadvantage is that the Ravagni patent does not provide any continuing visual references for playing the instrument. A further disadvantage is that potentially many different sheets would be required to teach the great variety of notes, scales or chords.

Several other patents have been issued which are directed to the problem of a visual device for teaching the playing of a musical stringed instrument. Examples of other patents include the Galbraith U.S. Pat. No. 852,407, the Fish U.S. Pat. No. 939,486, the Finney U.S. Pat. No. 1,719,604, the Pipkin U.S. Pat. No. 2,788,699, the Mulchi U.S. Pat. No. 3,153,970, the Sapinski U.S. Pat. No. 3,854,370, the Gilbert U.S. Pat. No. 3,943,815, the Feldman U.S. Pat. No. 3,978,756, the Johnson U.S. Pat. No. 3,978,757, the Ratanangsu U.S. Pat. No. 4,080,867, the Habicht U.S. Pat. No. 4,545,281, and the Nance U.S. Pat. No. 4,712,464.

Though the prior art patents mentioned above attempt to provide visual aids for learning to play conventional fretted and unfretted stringed instruments, these teaching systems still fail to provide permanent visual note-references that are easily learned and rapidly recognized. A related problem with these prior systems is that they are difficult to utilize in actual playing situations, as opposed to practice or learning sessions. Therefore an improved system for referencing notes in the playing of conventional fretted and unfretted stringed instruments is needed that provides an easily learned and rapid visual recognition system for note locations, which can be utilized in actual playing situations.

DETAILED DESCRIPTION OF SPECIFIC EMBODIMENTS

Figure 1B:
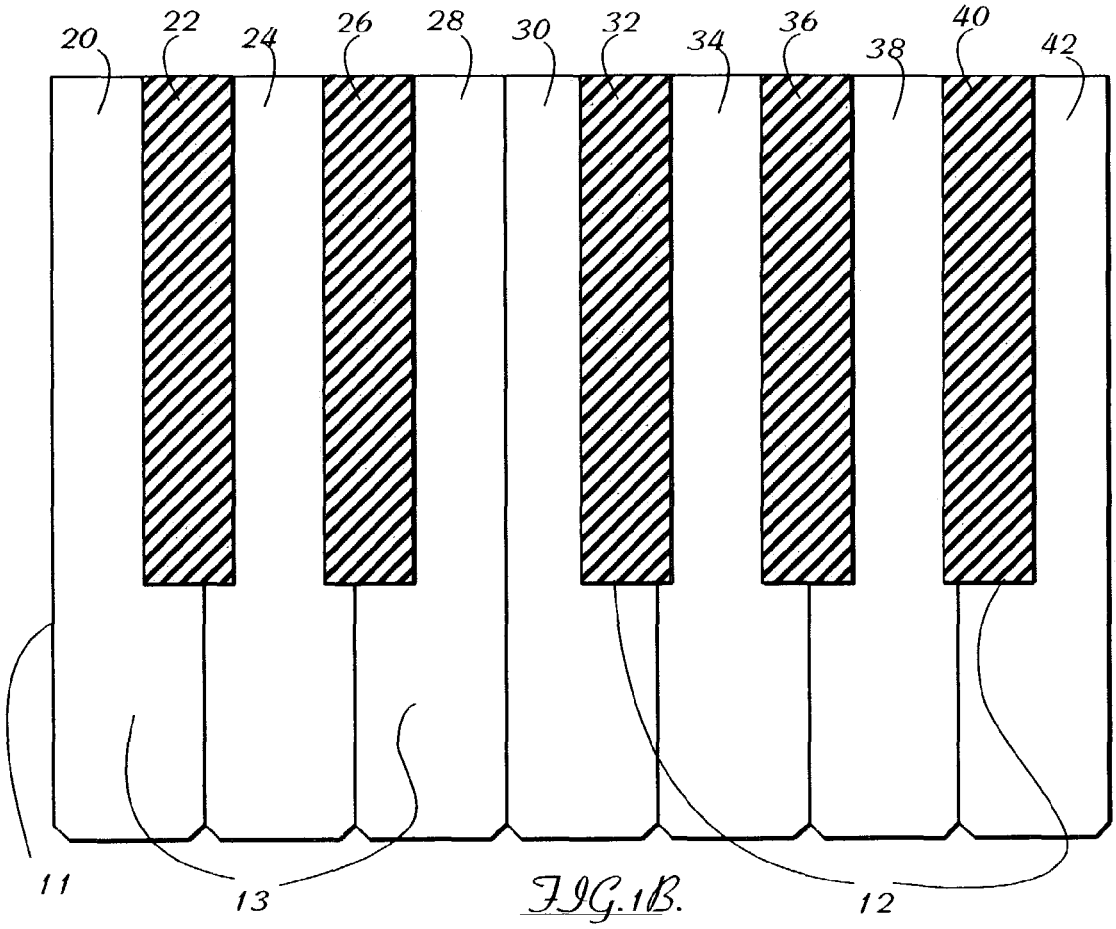
FIG. 1B is a top view of a keyboard corresponding to the array of fingerboard position markers of FIG. 1A, according to an embodiment of this invention.

The present invention provides an apparatus for improved note recognition in the playing of stringed instruments. The invention includes a fingerboard with a novel array of fingerboard position markers, which improves note recognition and provides a reference for all notes, all scales, and all chords without the need to change marks on the fingerboard. The invention uses marks in which the mark-location is note-referencing and the mark-type is permanent. The position markers used by the invention are the standard, permanent fingerboard marks previously defined herein, as position markers. Position markers are typically embedded permanently in the fingerboard as inlays, or permanently affixed to the fingerboard by painting marks onto the fingerboard surface. Position markers are placed flush with the fingerboard surface and are clearly visible in contrast to the fingerboard. Position markers are a component part of the fingerboard, typically fastened or applied to the fingerboard in the manufacturing process of the stringed instrument.

The novel array of position markers may exist in different orderly arrangements on the fingerboard, and since permanently affixed to the fingerboard, the arrangement must be predetermined. One such predetermined arrangement of the novel array of position markers is based on the well known pattern of black and white keys on a piano keyboard. This pattern will be referred to herein as the "piano key pattern." A piano key pattern array embodiment, once affixed to the fingerboard, would not change, despite the innumerable changes in note selections which can be made by a player while referencing the position markers.

This novel array of position markers is placed at note locations on the fingerboard of an actual stringed instrument, in one-to-one correspondence with each string, corresponding to the notes of the black keys of the piano. The black keys correspond to the notes of the F#/Gb (read F "sharp" and G "flat") major pentatonic scale. The note locations on the fingerboard corresponding to the white keys of the piano may be indicated in this preferred embodiment by the absence of position markers, such that the black key notes are distinguished from the white key notes. The white keys correspond to the notes of the C major scale.

Alternatively, the novel array of position markers can be placed proximate the notes consisting of B, E, A, D, and G. This orderly arrangement of position markers is particularly useful because the note intervals in fourths (i.e. the intervals from B to E, E to A, A to D, and D to G) and fifths (i.e. the intervals from G to D, D to A, A to E, and E to B) are made readily apparent with this array of position markers. Also, these position markers correspond to the notes of the G major pentatonic scale (G, A, B, D, and E). This pattern will be referred to herein as the "B, E, A, D, G pattern."

Also alternatively, the novel array of position markers can be placed at note locations on the fingerboard of an actual stringed instrument, in one-to-one correspondence with each string, corresponding to the notes of any individual major pentatonic scale, referred to herein as a "major pentatonic scale array," which includes a piano key pattern array with black keys marked and the B, E, A, D, G pattern array.

Additionally, in utilizing a piano key pattern array, the novel array of position markers can be placed at note locations on the fingerboard of an actual stringed instrument, in one-to-one correspondence with each string, corresponding to the notes of the C major scale, referred to herein as the "C major scale array." The notes of the C major scale correspond to the white keys of the piano. The note locations on the fingerboard corresponding to the black keys of the piano may be indicated in this preferred embodiment by the absence of position markers, such that the white key notes arc distinguished from the black key notes. The black keys correspond to the notes of the F#/Gb major pentatonic scale.

Also alternatively,the novel array of position markers can be placed at note locations on the fingerboard of an actual stringed instrument, in one-to-one correspondence with each string, corresponding to the notes of any individual major scale, referred to herein as a "major scale array," which includes the C major scale array, that is equivalent to a piano key pattern array with white keys marked.

To best understand how the present invention improves note recognition in playing stringed instruments it is first helpful to discuss the piano key pattern, and realize that it is a beneficial system for note recognition. In adapting the piano key pattern to stringed instruments, as provided by the present invention, note recognition can be further improved. This further improvement is achieved by adding distinctions to position markers for certain notes while continuing to indicate the basic piano key pattern.

Each key of the conventional piano keyboard corresponds to a note of the chromatic scale. The white keys correspond to the notes of the C major scale, which are the notes C, D, E, F, G, A, and B. These notes are referred to herein as "white key notes." The black keys correspond to the notes of the F#/Gb major pentatonic scale, which are the notes F#/Gb, G#/Ab, A#/Bb, C#/Db, and D#/Eb. These notes are referred to herein as "black key notes." This arrangement of black and white keys divides the black keys in alternating groups of two and three. The notes C#/Db and D#/Eb form a group of two black keys. These notes are referred to herein as a "group of two." The notes F#/Gb, G#/Ab, and A#/Bb form a group of three black keys. These notes are referred to herein as a "group of three." In this piano key pattern array embodiment, fingerboard position markers of the present invention may also be referred to as a group of two or group of three, corresponding to the same notes described above for the black keys of the piano. These groupings form an arrangement of position markers which facilitate note recognition, and which the present invention adapts to the stringed instrument fingerboard.

The sequence of black and white keys on a piano keyboard forms a pattern which is an established system for indicating the location of notes corresponding to each piano key. A user could define the repeated pattern of the sequence beginning on any note. However, for purposes of example, if the user begins with the note C, a white key, and moves to the right (assuming the user is facing the piano in normal playing position), the next higher pitch note is C#/Db, a black key. The note C#/Db is followed by the note D, a white key; the note D#/Eb, a black key; the note E, a white key; the note F, a white key; the note F#/Gb, a black key; the note G, a white key; the note G#/Ab, a black key; the note A, a white key; the note A#/Bb, a black key; and then the note B, a white key. The next key begins the pattern again with the note C, a white key corresponding to the note C which is one octave higher than the note C at the beginning of this example. The sequence of black and white keys then continues for this next higher octave, containing the same note names in the exact same pattern, the only difference being the octave higher pitch for each note. Beginning with the note C, the pattern of keys is: white, black, white, black, white, white, black, white, black, white, black, white; ending with the note B.

FIG. 1B depicts a portion of a piano keyboard 11. The piano keyboard is as conventionally configured with black keys 12 and white keys 13. Keyboard instruments other than the piano also employ this standard configuration and layout of keys, without significant variation. As typical, the black keys are narrower and not as long as the white keys and, though not shown in this top view, the black keys are raised higher than the white keys. These physical differences provide an advantage unique to the piano both for ease of playing the keys and for further distinguishing, by sight and touch, the black keys from the white keys. This advantage due to physical location and shape of the keys does not exist for stringed instruments. A preferred embodiment of the present invention adapts the piano key pattern wherein the position markers distinguish the notes consisting of C#/Db, D#/Eb, F#/Gb, G#/Ab and A#/Bb from the notes consisting of C, D, E, F, G, A, and B. Because the piano key pattern is standardized for note recognition, various specific embodiments will be illustrated which adapt the piano key pattern to stringed instruments.

Figure 1A:
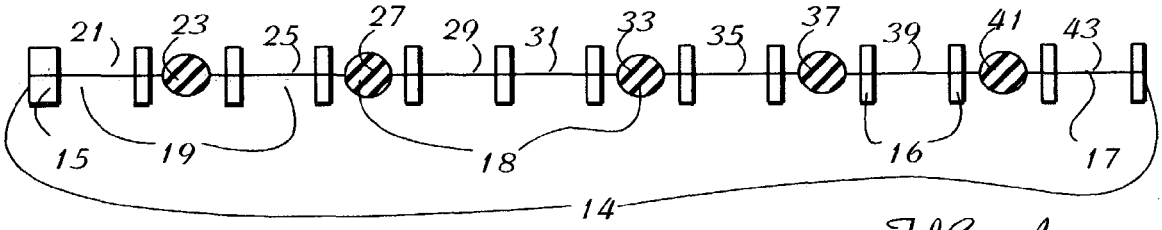
FIG. 1A is a top view of an array of fingerboard position markers for a fretted, single-stringed instrument, according to an embodiment of this invention.

FIG. 1A depicts a fretted, stringed instrument 14. For the purpose of illustration, the stringed instrument has only one string 17. The nut 15, the frets 16, and the string, which is open-tuned to the note B are also shown, though not to scale, as conceptual elements of the generic stringed instrument. This fretted, single-stringed instrument is referred to herein as a "fingerboard representation" because it does not exactly replicate an actual stringed instrument, but rather serves as a conceptual model to demonstrate the function and utility of certain aspects of the present invention. It will be noted upon inspection that the fingerboard representation of FIG. 1A differs from an actual instrument in several ways: an actual fingerboard as such is not depicted, and the string is not shown to be continuous. Also, the frets of this representation are spaced uniformly to approximate the spacing on the adjacent piano keyboard, rather than with decreasing spacing away from the nut as would be necessary to create half note intervals with the proper musical pitch on an actual stringed instrument.

Figure 2B:
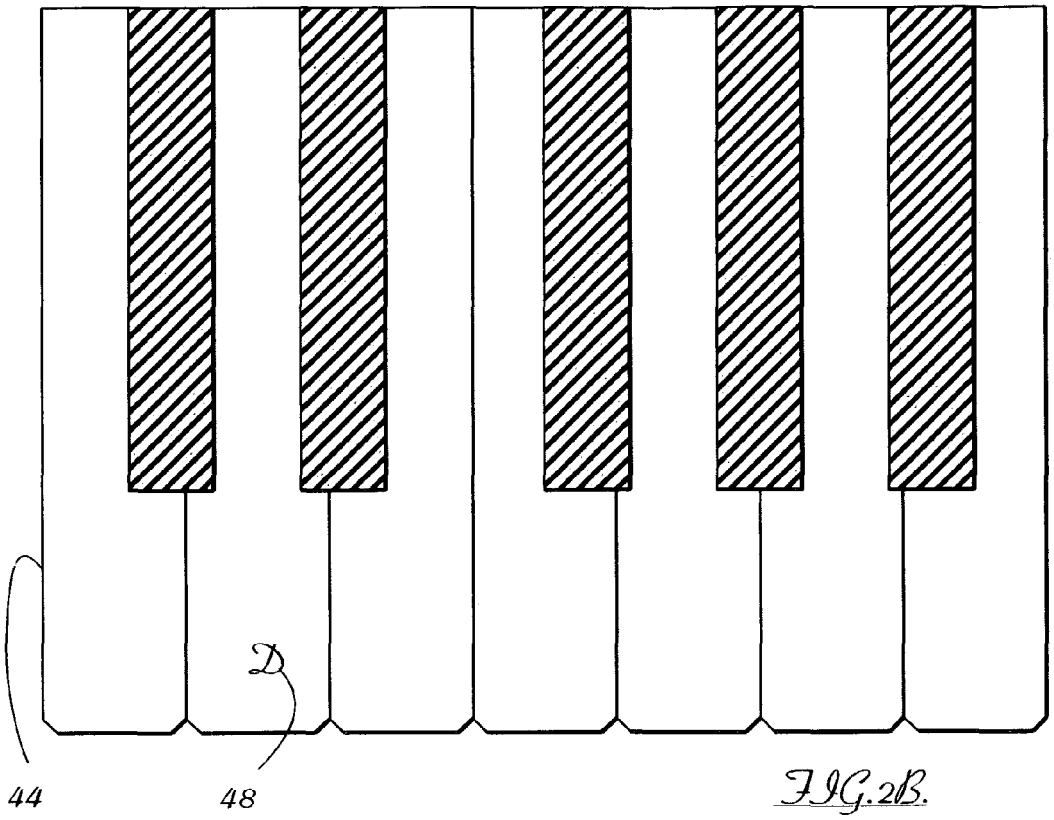
FIG. 2B is a top view of a keyboard corresponding to the array of fingerboard position markers of FIG. 2A, according to an embodiment of this invention.
Figure 2A:
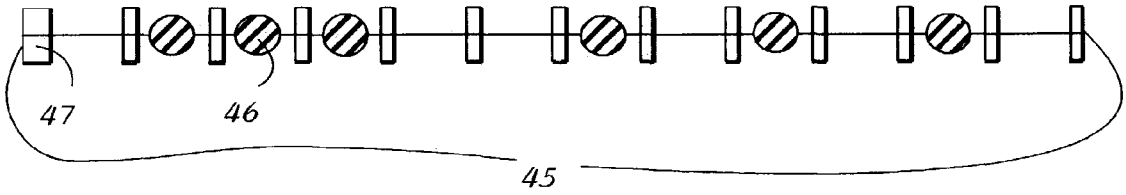
FIG. 2A is a top view of an array of fingerboard position maker for a fretted, single-stringed instrument, according to an embodiment of this invention.

The fingerboard representation is used in FIGS. 1A, 2A, A, and 4A, to emphasize and clearly show the relationship of an array of position markers, using position markers 18, which for the present invention directly relate to the piano key pattern, as shown in FIGS. 1B, 2B, 3B, and 4B. It is easier to recognize notes when-viewing this simplified fingerboard representation than is possible with an actual stringed instrument. There are three primary reasons for this ease of recognition: one is the close arid uniform spacing of frets, the second is the relatively clear display of the group of two and group of three position markers, and the third is that only one string is shown. While the fingerboard representation is useful for displaying various embodiments of the novel position markers, it tends to minimize some of the problems encountered when adapting the piano key pattern to the fingerboards of actual stringed instruments. With actual stringed instruments, the width of the fret-space varies and may be much wider apart than the standard spacing of piano keys; the group of two and group of three position markers may be truncated; and there are generally four, five, or six independently tuned strings on a stringed instrument. In FIGS. 1A through 4B, the sequence truncation problem is introduced using the fingerboard representation to explain the improvements provided by various position marker shapes and piano key pattern adaptations.

A more detailed discussion follows, of the other issues encountered with actual stringed instruments is provided with alternative embodiments of the present invention, as shown in FIGS. 5 through 9. In FIG. 1A, position markers 18 and unmarked fret-space locations 19 are shown in a specific embodiment of the present invention in FIG. 1B, the white key 20 on the piano keyboard 11 corresponds to the note C. On the fingerboard representation 14 of FIG. 1A, the finger stopping location for this same note C is at the fret-space location 21 next to the nut 15. In a similar fashion, the notes on the keyboard corresponding to the notes on the fingerboard representation are:

The black key 22 and the marked fret-space location 23 correspond to the note C#/Db.

The white key 24 and the unmarked fret-space location 25 correspond to the note D.

The black key 26 and the marked fret-space location 27 correspond to the note D#/Eb.

The white key 28 and the unmarked fret-space location 29 correspond to the note E.

The white key 30 and the unmarked fret-space location 31 correspond to the note F.

The black key 32 and the marked fret-space location 33 correspond to the note F#/Gb.

The white key 34 and the unmarked fret-space location 35 correspond to the note G.

The black key 36 and the marked fret-space location 37 correspond to the note G#/Ab.

The white key 38 and the unmarked fret-space location 39 correspond to the note A.

The black key 40 and the marked fret-space location 41 correspond to the note A#/Bb.

Finally, the white key 42 and the unmarked fret-space location 43 correspond to the note B.

After the note B, the above pattern begins again with the note C, one octave higher (not shown) than the note C at the beginning of this example. With this embodiment of the present invention, the piano key pattern is readily adapted to stringed instruments, by placing position markers at fret-space locations in one-to-one correspondence with each string and corresponding to the black key notes of the piano keyboard.

Having identified the unique locations of all the notes in reference to the piano key pattern, it is helpful to understand how the piano key pattern assists in rapid note recognition. On the piano keyboard, rapid note recognition is assisted by noticing that there are two separate groups of black keys. As shown in FIG. 1B, a group of two black keys consists of the notes C#/Db 22 and D#/Eb 26, and a group of three black keys consists of the notes F#/Gb 32, G#/Ab 36, and A#/Bb 40. These two groups repeat alternately on the piano keyboard, except at either end of the keyboard where the black and white key sequence is truncated. Similarly, when the piano key pattern is applied with position markers to the stringed instrument fingerboard representation 14 of FIG. 1A the user can recognize a group of two position markers consisting of the notes C#/Db 23 and D#/Eb 27, and a group of three position markers consisting of the notes F#/Gb 33, G#/Ab 37, and A#/Bb 41.

The notes on the piano keyboard can be quickly recognized in relation to these two groups of black keys, except at either end of the keyboard where the black and white key sequence is truncated. By the novel adaptation of the present invention, the notes on a stringed instrument fingerboard can also be quickly recognized, but the process, in general, is more involved than with a piano keyboard. To demonstrate the mental process of note recognition in relation to the group of two and the group of three, this process can be described in step by step fashion. Beginning with the black key notes on the piano keyboard 11 and fingerboard representation 14:

The note C#/Db is always the left black key 22 in the group of two black keys; and the note C#/Db is always the fret-space location 23 of the left position marker in the group of two position markers.

The note D#/Eb is always the right black key 26 in the group of two black keys; and the note D#/Eb is always the fret-space location 27 of the right position marker in the group of two position markers.

The note F#/Gb is always the left-most black key 32 in the group of three black keys; and the note F#/Gb is always the fret-space location 33 of the left-most position marker in the group of three position markers.

The note G#/Ab is always the middle black key 36 in the group of three black keys; and the note G#/Ab is always the fret-space location 37 of the middle position marker in the group of three position markers.

The note A#/Bb is always the right-most black key 40 in the group of three black keys; and the note A#/Bb is always the fret-space location 41 of the right-most position marker in the group of three position markers.

Next, the white key notes may be uniquely identified in relation to the piano key pattern:

The note C is always the white key 20 located immediately to the left of the left black key in the group of two black keys, and the note C is always the unmarked fret-space location 21 immediately to the left of the left position marker in the group of two position markers.

The note D is always the white key 24 located between the two black keys in the group of two black keys, and the note D is always the unmarked fret-space location 25 between the two position markers in the group of two position markers.

The note E is always the white key 28 immediately to the right of the right black key in the group of two black keys, and the note B is always the unmarked fret-space location 29 immediately to the right of the right position marker in the group of two position markers.

The note F is always the white key 30 located immediately to the left of the left-most black key in the group of three black keys, and the note F is always the unmarked fret-space location 31 immediately to the left of the left-most position marker in the group of three position markers.

The note G is always the white key 34 located immediately to the left of the middle black key in the group of three black keys, and the note G is always the unmarked fret-space location 35 immediately to the left of the middle position marker in the group of three position markers.

The note A is always the white key 38 located immediately to the right of the middle black key in the group of three black keys, and the note A is always the unmarked fret-space location 39 immediately to the right of the middle position marker in the group of three position markers.

The note B is always the white key 42 located immediately to the right of the right-most black key in the group of three black keys, and the note B is always the unmarked fret-space location 43 immediately to the right of the right-most position marker in the group of three position markers.

Therefore, the piano key pattern, when adapted to a stringed instrument fingerboard through the use of position markers, provides a straightforward arrangement for recognizing notes on the fingerboard in relation to a group of two or group of three position markers.

When applying this piano key pattern of position markers on actual instruments and to various typical open-string tunings, certain issues arise that are specific to the adaptation of the piano key pattern to stringed instrument fingerboards. FIGS. 5 through 9 illustrate depictions of actual fingerboards and can be utilized to discuss specific applications of the present invention. In actual fingerboards, fret spacing increases toward the nut. This increases the distance between position markers and makes visual recognition of position marker patterns more difficult. At the opposite end of the fingerboard, pattern recognition is easier because the frets, notes, and position markers are closer together. The fret spacing distance for instruments such as guitars and bass guitars is wider near the nut and over much of the fingerboard than piano keys on a standard keyboard. The user must visually scan a larger area along the string to determine the pattern, which slows note recognition. Additionally, the, truncation of the note sequence at the nut and at the end of the fingerboard opposite to the nut presents another issue or problem. FIGS. 1A, 2A, 3A, and 4A, do not illustrate the note spacing problem, but can illustrate the note sequence truncation problem. They do not illustrate truncation of a group of two or a group of three. Referring to FIG. 1A, the note sequence is truncated at the nut 15 for the open string tuning to the note B. If the field of vision is confined to fret-space locations lying between the nut and fret-space location 39, the user cannot tell whether the position markers at fret-space locations 23 and 27 are within a group of two, or a group of three with the nut, truncating the third position marker. The user must also visually inspect the position marker at fret-space location 41 along with fret-space locations 33 and 37 to conclude that those position markers form a group of three and therefore the position markers near the nut are a group of two. The groups of two and groups of three alternate according to the piano key pattern. The basic process of recognizing notes using the piano key pattern is to identify them by their location in relation to a group of two or group of three piano black key notes. In response to these issues, further improvements can be made through the addition of one or more distinguishing marks, as shown by the examples given in FIGS. 2A, 3A, 4A, 5, 6, 7, 8, and 9.

FIG. 2B depicts the same portion of a piano keyboard 44 as shown in FIG. 1B, and FIG. 2A shows the same exemplary fretted one-stringed instrument 45, as shown in FIG. 1A, with an additional note distinction for improved recognition of a group of two or a group of three. The additional note distinction is a circle shaped position marker 46 at the D note location on the fingerboard representation. The corresponding note D 48 on the piano keyboard 44 has been identified with the letter D in the figure. Other notes could be selected for marking, such as the note G or others. Compared with the apparatus of FIG. 1A, the example chosen for an additional position marker in FIG. 2A improves on the truncation problem near the nut 47. In this example, the user can determine by direct observation that the group of two consists of the marked fret-spaces on either side of and adjacent to the additional position marker 46. For this example, this additional distinguishing position marker eliminates the ambiguity, which existed in FIG. 1A, showing the group of two might actually be a truncated group of three.

As a practical matter, the optimal arrangement of marks provides enough information to uniquely identify notes, yet be a simple as possible for speed and ease of note recognition. Too many marks, such as displaying alphabetical note names on every note location, cannot be interpreted quickly enough to aid in real-time playing. Too few marks do not provide enough information to readily recognize all the notes. While the improvement shown in FIG. 2A is helpful and useful, further improvements are offered towards the goal of unique note recognition with relative ease.

Figure 3B:
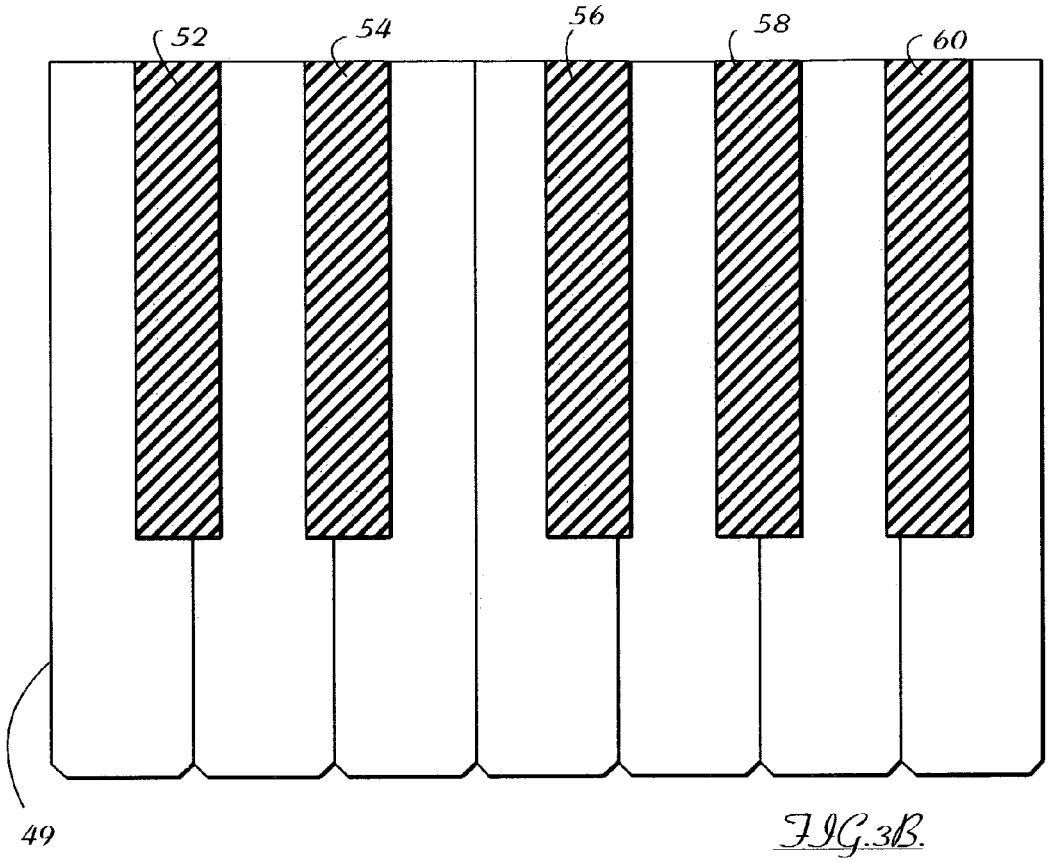
FIG. 3B is a top view of a keyboard corresponding to the array of fingerboard position markers of FIG. 4A, according to an embodiment of this invention.
Figure 3A:
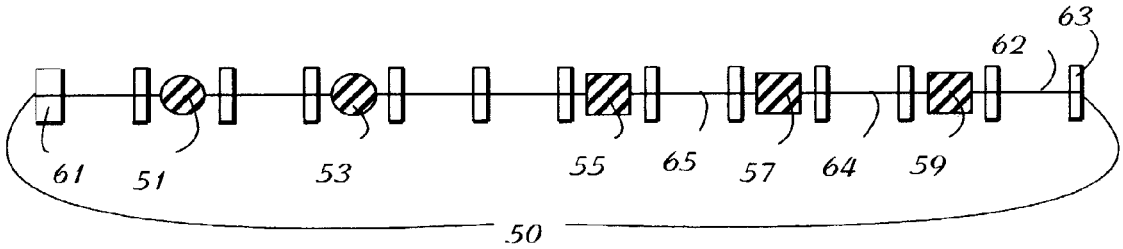
FIG. 3A is atop view of an array of fingerboard position markers for a fretted, single-stringed instrument, according to an embodiment of this invention.

FIGS. 3B and 3A depict the same portion of a piano keyboard 49 and fingerboard representation 50, respectively, as also shown in FIGS. 1B and 1A with an additional distinction in position markers shown for improved note recognition. In this example, the notes on the fingerboard corresponding to the group of two piano black key notes are clearly distinguished with circle shaped position markers from the group of three piano black key notes which have been given square shaped position markers. The group of two consists of the notes C#/Db (fret-space location 51, piano key 52) and D#/Eb (fret-space location 53, piano key 54). The group of three consists of the notes F#/Gb (fret-space location 55, piano key 56), G#/Ab (fret-space location 57, piano key 58), and A#/Bb (fret-space location 59, piano key 60).

By virtue of the position marker shape distinctions between the two groups, this specific embodiment also improves the truncation problem near the nut 61. By direct inspection, the user can observe either or both of the position markers at fret-space locations 51 and 53 and, because they are circle shaped position markers, conclude that they are the group of two, and are not part of a truncated group of three.

In actual practice, a person can quickly look along the string and fingerboard to visually interpret the pattern of position markers, but a step by step description will be used here to further demonstrate the logical process of note recognition as it is accomplished using novel forms of the piano key pattern adapted to fingerboards. Turning now to the opposite end of the fingerboard for example purposes, it is desired to use the position markers to determine the note for the unmarked fret-space location 62. The sequence of position markers is truncated at the fret 63. The user would begin by looking at adjacent fret-spaces for clues. If the user confines their field of vision to fret-space locations 62 and 59, it is determined that the note at location 62 is a half step higher than one of the notes from the group of three (all notes within the group of three have square shaped position markers in this example). With only this much information, there are three possibilities for the note at fret-space location 62, either G, A, or B. Continuing to visually scan the fingerboard two more fret-spaces along the string toward the nut 61, and confining the field of vision to fret-space locations 62, 59, 64, and 57, the user encounters another square shaped position marker at fret-space location 57. With this information, the note at fret-space location 62 must either be A (where the group of three is truncated by the fret 63) or the note must be B (where the group of three is not truncated). To uniquely identify the note at fret-space location 62, it is necessary to visually scan the fingerboard along the string two more fret-spaces toward the nut 61. Once the field of vision is increased to include fret spaces 65 and 55, the user encounters another square shaped position marker at fret-space location 55. It is thus determined that the note in question, at fret-space location 62, must be the note B.

Figure 4B:
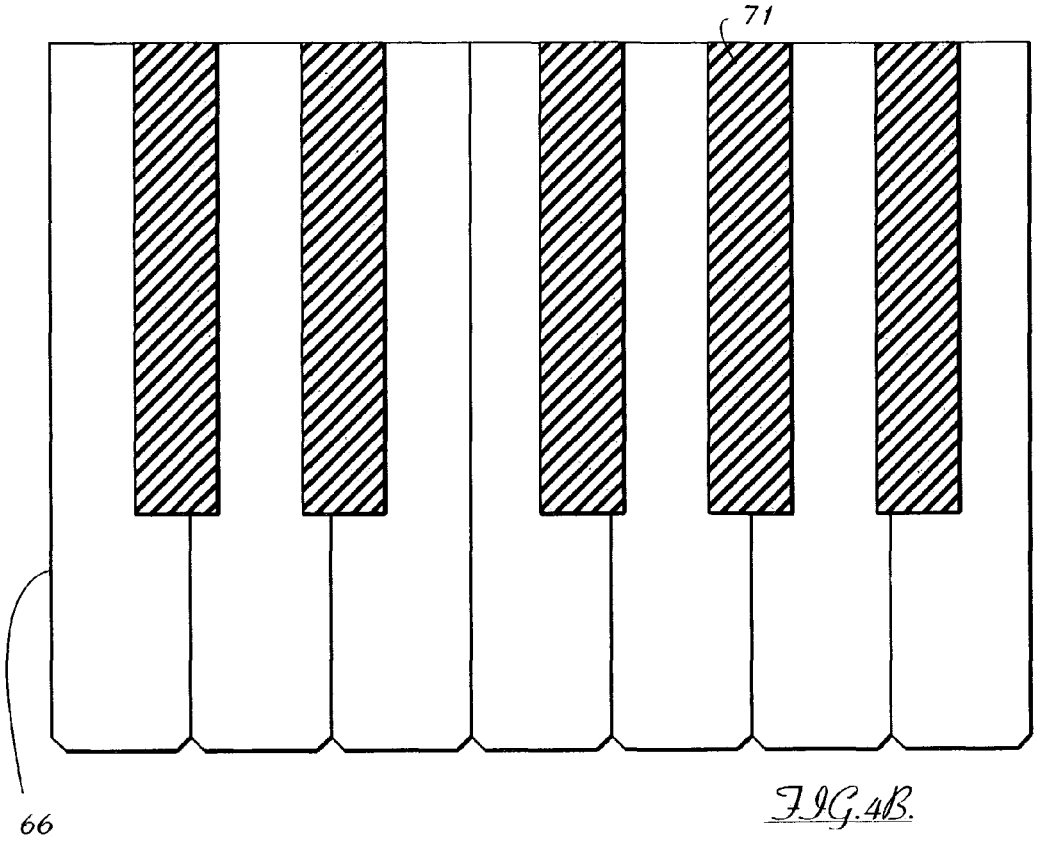
FIG. 4B is a top view of a keyboard corresponding to the array of fingerboard position markers of FIG. 4A, according to an embodiment of this invention.
Figure 4A:
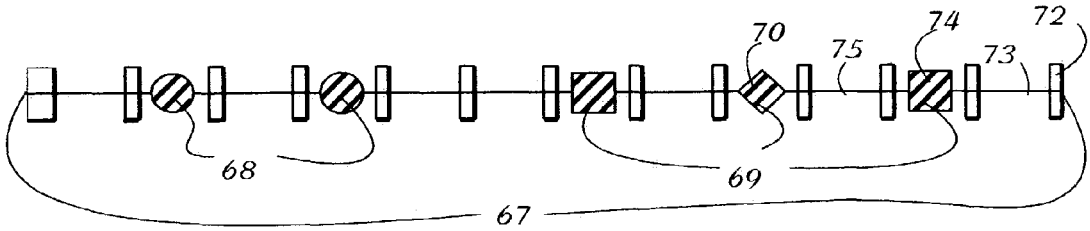
FIG. 4A is a top view of an array of fingerboard position markers for a fretted, single-stringed instrument according to an embodiment of this invention.

FIGS. 4B and 4A depict the same, portion of a piano keyboard 66 and fingerboard representation 67, respectively, as also shown in FIGS. 3B and 3A with an additional distinction in position markers shown for improved note recognition. In this example, not only is the group of two 68 distinguished from the group of three 69, but the note location 70 in the middle, of the group of three piano black key notes is given its own unique identifying symbol, a diamond shaped position marker. The note corresponding to the fret-space location of the diamond shaped position marker is G#/Ab, shown on the piano keyboard 66 as the black key 71. The most obvious additional improvement this offers for note recognition is that all of the locations of the note G#/Ab are uniquely made apparent by direct inspection, corresponding to the fret-space locations of all diamond shaped position markers.

To compare this improvement to the apparatus shown in FIG. 4A with the embodiment shown in FIG. 3A, the same note identification process will be applied adjacent to the actual fret 72 where the string is truncated. It is desired to identify the note corresponding to the fret-space location 73. The user would begin by looking at adjacent fret-spaces for clues. If the user confines their field of vision to fret-space locations 73 and 74, it is determined that the note at fret-space location 73 is a half step higher than a note location having a square position marker. The square position marker as used in this example corresponds to the location of either the note F#/Gb or the note A#/Bb. Therefore, the possibilities for the note of interest at fret-space location 73 are narrowed to either G or B. At this point in the example, for the embodiment of FIG. 3A, there were three possibilities. Increasing the field of vision to include fret-space locations 75 and 70, the user encounters a diamond shaped position marker at fret-space location 70. With this information, it can be concluded that the note at fret-space location 73 must be B. This is because the presence of the diamond shaped position marker at fret-space location 70 eliminates the possibility that a group of three is truncated by the fret 72. This example demonstrates that the specific embodiment shown in FIG. 4A, further improves the ability to quickly recognize notes when compared to the specific embodiment shown in FIG. 3A. The additional distinction in position markers assists with unique note recognition by removing some of the ambiguity in the pattern shown in FIG. 3A, while still being simple and easy to recognize with minimal visual cues.

In the previous examples, a fingerboard representation has been used for illustrative purposes toward understanding how the novel position markers are based on the piano key pattern. It was also shown how various shapes of position markers, still in keeping with the piano key pattern, can result in improved adaptations which overcome issues such as truncation of note sequences at the nut and opposite end of the fingerboard.

To further an understanding of the use of the present invention, the embodiments shown in FIGS. 5 through 9 are displayed on the fingerboard of an actual stringed instrument, to relative scale. In contrast with the fingerboard representation displayed in FIGS. 1A, 2A, 3A, and 4A, the actual fingerboard illustrations show the increasing fret spacing toward the nut, show the truncation of the group of two and group, of three, and show the embodiments where multiple strings are present. It will be apparent to those skilled in the art that the novel array of position markers of the present invention may be used with any stringed instrument played by use of or in reference to a fingerboard. For purposes of illustration, a bass guitar is used in the following description of specific embodiments.

Figure 5:
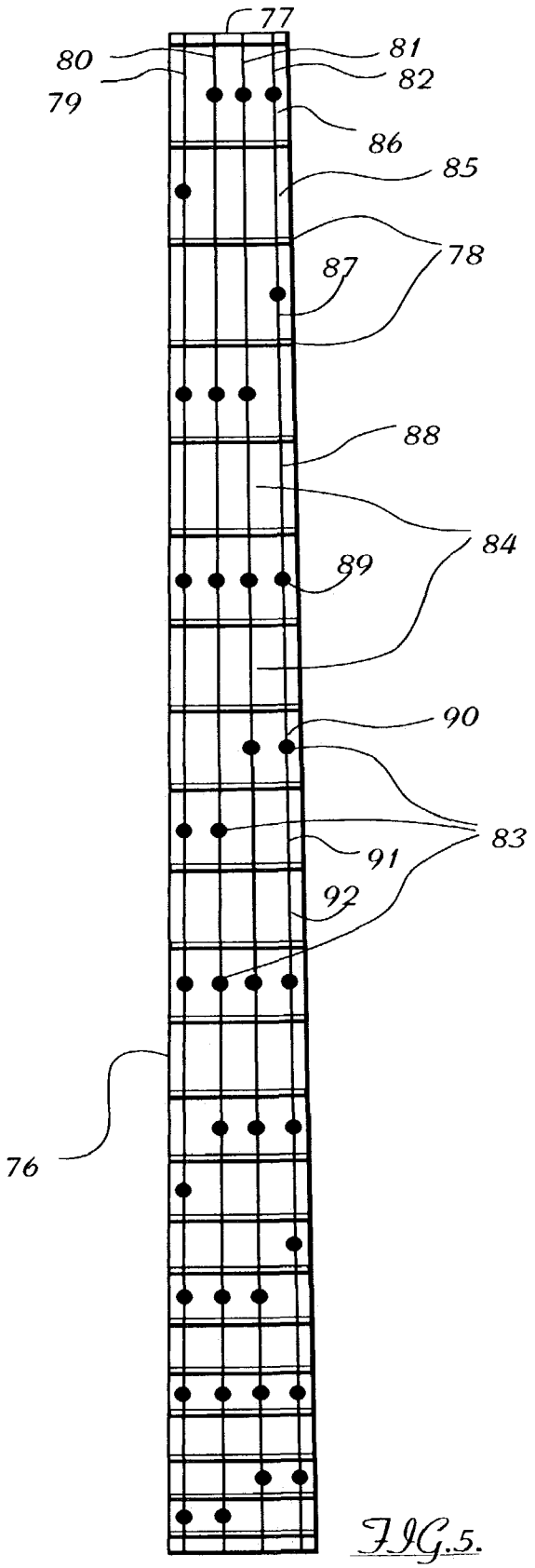
FIG. 5 is a top view of an array of fingerboard position markers for a bass guitar fingerboard, according to an embodiment of this invention.

FIG. 5 depicts a top view of an array of fingerboard position markers for a bass guitar fingerboard, according to an embodiment of this invention, corresponding to the pattern and shape of position markers shown in FIG. 1A. The diagram shows a typical bass guitar fingerboard 76 with a nut 77, frets 78, and strings 79, 80, 81, and 82 tuned to standard open tuning notes E, A, D, and G, respectively, and position markers 83 of the present invention. In viewing the diagram, the unmarked fret-space locations 84 correspond to the white key notes of the piano keyboard. In this figure, drawn to relative scale, it will be noticed that the frets 78 are spaced farther apart as they are located nearer to the nut 77.

Before proceeding with a note recognition example for the specific embodiment shown in FIG. 5, it will be helpful to discuss in more detail the principles for improved note recognition, as these principles apply to the piano key pattern and its adaptation to stringed instruments. When considering the embodiments on an actual fingerboard, rather than a fingerboard representation, it is important to consider actual physical note spacing and note location on the various instruments, the musician's comfortable and practical field of vision in looking at the fingerboard while playing, and even the mental process which occurs while recognizing notes and playing them on an instrument. In this regard, further elaboration is offered on the two main concepts important to understanding the novel improvements. One concept is the visual recognition process that a musician must use to interpret the position markers, or groups of position markers, while playing. The visual recognition process involves seeing the pattern of position markers and, based on the information, selecting and playing the desired notes. To optimize the effectiveness of position markers, neither too many nor too few position markers must be used. The piano key pattern has proven effective for note recognition on the piano keyboard. The second concept important to preferred adaptations of the piano key pattern is the application of logic to uniquely identify notes by following the defined rules of a particular position marker pattern. The source information for making logical conclusions will be found at each fret-space location along a string on the fingerboard. The fret-space location will either have a position marker, or it will not have a position marker. The shape, size, color, design, or any other distinguishing feature of the position marker will also follow rules defined for each specific position marker pattern, and the rules are subject to logical interpretation for note identification.

The most effective adaptation of the piano key pattern to a fingerboard involves a balance between visual recognition and logic. For example, alphabetic note names applied to all note locations would maximize the logical identification concept by uniquely identifying every note. Such a marking system, however, would be extremely poor for visual recognition, which needs to occur quickly and with relative case to be useful in real-time playing. In the present invention it is understood, and the examples and figures illustrate, that the novel pattern of position markers may take on numerous embodiments, offering varying degrees of improvement to the problem of note recognition in the playing of stringed instruments. The improvements realized for a specific embodiment will depend on the simultaneous operation of visual recognition and logic.

Figure 6:
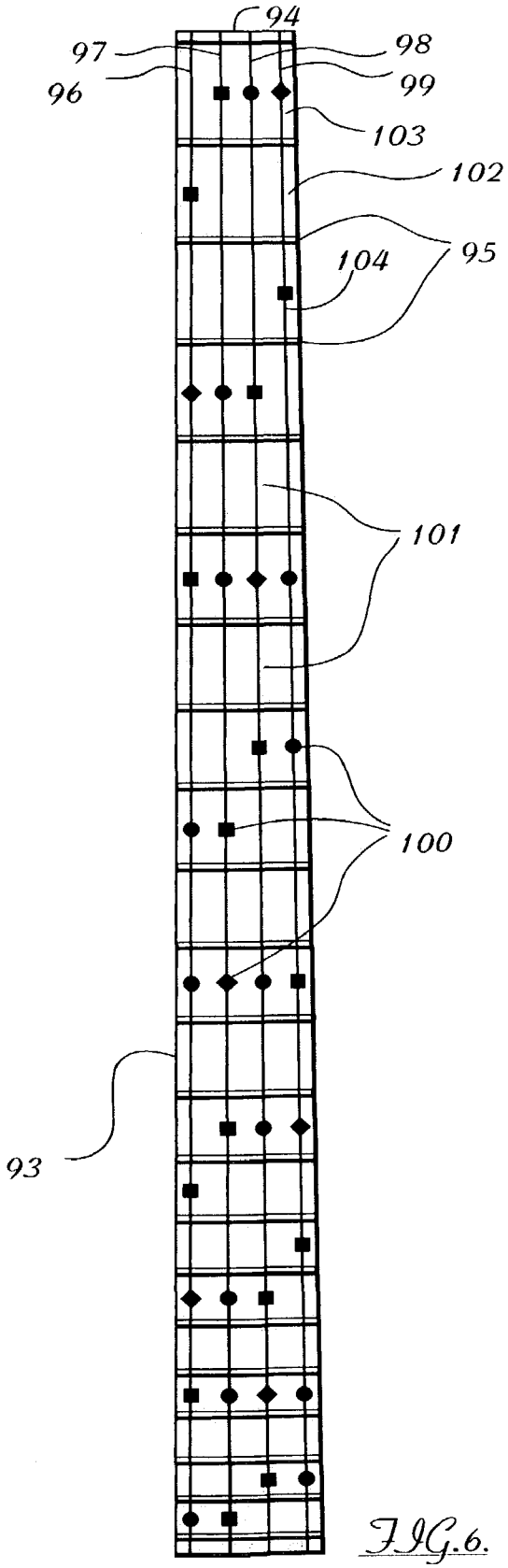
FIG. 6 is a top view of an array of fingerboard position markers for a bass guitar fingerboard, according to an embodiment of this invention.

The preceding amplification of these two concepts provides background towards the examples and comparisons given with reference to FIG. 5 and FIG. 6. For the specific embodiment shown in FIG. 5, it is desired to use the position markers to determine the note for the unmarked fret-space location 85. The user begins by looking at adjacent fret-spaces for clues. If the user confines their field of vision to the fret-space locations 86 and 87, on either side of the note location of interest, it is determined that the note at location 85 is between two position markers. Based on this information, the note of interest is either D, if between the position markers of a group of two, or if between position markers within a group of three the note could be G or A. To identify the note, it is necessary to visually scan the fingerboard along the string away from the nut 77. The string 82 is truncated at the nut 77, preventing further examination in that direction, and it is assumed that the information of the open string tuning is not used to identify the note in question. The logical procedure is to first determine whether the position markers adjacent to the note in question are part of a group of two or a group of three. In scanning along the string away from the nut 77 three fret-spaces from the note in question, the user encounters an unmarked fret-space 88. In accordance with the piano key pattern, this fact eliminates the possibility that the note in question is a G, because the only possible way that a G could exist at fret-space 85 would be if a position marker existed at fret-space 88 as part of a group of three. Continuing to scan along the string away from the nut 77, position markers will be encountered at fret-spaces 89 and 90. Without looking farther along the string, it is still not possible to determine whether the pair of marked fret-spaces 86 and 87 or the pair 89 and 90 form a group of two or are portions of a group of three. Continuing to scan along the string two more fret-spaces, consecutive unmarked fret-spaces 91 and 92 are encountered. This provides conclusive information that marked fret-spaces 89 and 90 form a group of two, and therefore the marked fret-spaces 86 and 87 on either side of the note in question are part of a group of three. This is because, except where truncated, every group of two is separated by two unmarked fret-spaces from every group of three, in accordance with the piano key pattern and embodiment of FIG. 5. With this information, the note in question at the unmarked fret-space 85 is uniquely determined to be the note A, and the example is concluded.

Those persons familiar with the playing of stringed instruments may recognize that the above procedure is not optimal for rapid note recognition, considering that ten fret-spaces along a string had to be viewed in order to resolve the pattern and identify the note in question. It does, nevertheless, provide an improvement over the conventional arrangement of position markers, because with practice the musician, employing the novel array of position markers of the present invention, would soon recognize the note locations without having to examine all ten fret-spaces. Experience indicates that the normal field of vision during playing is approximately two to five inches as measured parallel to the strings. This vision area is centered around where the musician's fingers are stopping the strings, with peripheral vision including some adjacent areas. On a bass guitar, this approximate vision area includes up to three or four fret-spaces. On a mandolin, for instance, this vision area could include up to four or five fret-spaces. The number of fret-spaces would vary with the individual player, stringed instrument, and also with fingerboard location on a given instrument due to the variation in fret spacing. With consideration for the normal viewing area during playing, it will be beneficial to devise other embodiments of the present invention such that the necessary logic to resolve a note's identity can be accomplished within a smaller number of fret-spaces adjacent to the note in question. It is also recognized that the musician will play notes on different strings, often changing rapidly from one string to another, and playing multiple strings at once. This makes it even more important to be able to identify the note on a given string by looking at a smaller number of adjacent fret-spaces. Ideally, the maximum number of adjacent fret-spaces necessary to identify any note would coincide with the normal viewing area used by musicians, which is approximately two to five inches along the fingerboard and parallel to the sings. This improvement is accomplished in the preferred embodiment shown in FIG. 6.

FIG. 6 depicts a top view of a bass guitar fingerboard apparatus with position markers in accordance with a preferred embodiment, corresponding to the pattern and shape of position markers of FIG. 4A. The diagram shows a typical bass guitar, fingerboard 93 with a nut 94, frets 95, and strings 96, 97, 98, and 99, tuned to, standard open, tuning notes E, A, D, and G, respectively, and position markers 100 of a preferred embodiment of the present invention. In viewing the diagram, the unmarked fret-space locations 101 correspond to the white keys of the piano keyboard. The locations of all the notes G#/Ab are found at the fret-spaces with the diamond shaped position markers. Looking at a diamond shaped position marker, the note G is located one fret-space nearer to the nut. The locations of all the notes D are found at the unmarked fret-space locations along a string and between the two fret-spaces with the circle shaped position markers. All the note locations on the fingerboard can be readily recognized through use of the novel array of position markers of the present invention.

To compare this preferred embodiment with that shown in FIG. 5 the note identification example will be repeated for the unmarked fret-space location 102. To identify this unmarked fret-space location, the user would look at the immediately adjacent fret-spaces and would observe the diamond shaped position marker at the adjacent fret-space 103. The diamond shaped position marker corresponds uniquely to the note G#/Ab, the middle position marker in a group of three, and therefore the note in question must be A. In this particular example, it was only necessary to observe one adjacent fret-space (two fret-spaces in total) in order to identify the note in question, compared with ten fret-spaces to identify the same note using the embodiment shown in FIG. 5. Also notice that the other adjacent fret-space 104 has a square shaped position marker, which also identifies it as being part of a group of three. Using the embodiment shown in FIG. 6 allows for recognition of any note by logical analysis using no more than four fret-spaces which are adjacent to and including the note in question. This corresponds to the normal viewing area typically used by musicians.

By this example it is shown that this preferred embodiment provides a desirable balance between visual recognition and logic to uniquely identify notes. The number of position markers is the minimum to display the piano key pattern which facilitates visual recognition. The unique shapes minimize the logical analyses necessary to resolve note identities within the approximate vision area normally used by musicians.

Figure 7:
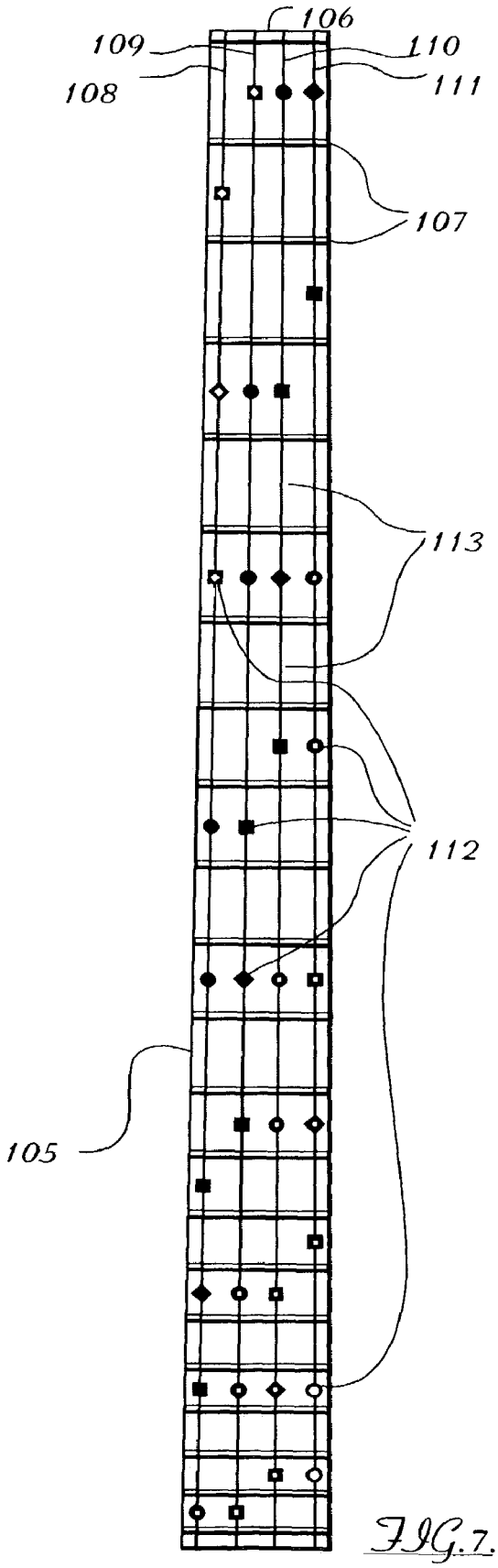
FIG. 7 is a top view of an array of fingerboard position markers for a bass guitar fingerboard, according to an embodiment of this invention.

FIG. 7 depicts the same apparatus as FIG. 6 with an additional distinction in position markers to indicate different octaves. The diagram shows a typical bass guitar fingerboard 105 with a nut 106, frets 107, and strings 108, 109, 110, and 111 tuned to standard open tuning notes E, A, D, and G, respectively, and position markers 112 indicating both note and octave distinctions. In this specific embodiment, the solid position markers of the embodiment shown in FIG. 6 are used, such as circles, squares, and diamonds, and include an additional distinction added to appropriate position markers to distinguish one octave from the other octaves. The specific embodiment shown in FIG. 7 shows one possible position marker array, most easily understood as distinguishing the various octaves beginning with the note C. The specific octave distinctions are as follows: within the first octave, the lowest musical pitch notes, the position markers include a small contrasting diamond shape inside each position marker. Within the second octave the position markers are solid, which is as shown in the preferred embodiment of FIG. 6, within the third octave the position markers include a small contrasting square shape inside each position marker, and within the fourth octave the position markers include a contrasting circle shape inside each position marker. The unmarked fret-space locations 113 correspond to the white key notes of the piano keyboard. This specific embodiment demonstrates that distinctions may be made to position markers in the manner of the present invention, which allow the, user to recognize the different octave locations of notes with relative ease.

Another preferred embodiment of the present invention is a stringed instrument apparatus wherein the position markers are proximate the notes consisting of B, E, A, D, and G. The orderly arrangement of the marks in this embodiment corresponds to all locations of the notes B, E, A, D, and G on the fingerboard. This array of position markers is particularly useful because the note intervals in fourths (i.e. the intervals from B to E, E to A, A to D, and D to G), and fifths (i.e. the intervals from G to D, D to A, A to E, and E to B) are made readily apparent with this array of position markers. These intervals occur frequently in stringed instrument music and are useful to the musician. Also, this array of position markers is useful for a bass guitar, guitar, mandolin or violin because the notes B, E, A, D, and G can, correspond to standard open string tuning notes for these instruments. Also, comparing the position marker locations in FIGS. 5 and 8, it is seen that the B, E, A, D, G array is related to the piano key array. The arrangement of position markers in one array is offset one half step from the other array. This is because the piano key pattern in FIG. 5 displays the F#/Gb major pentatonic scale, and the B, E, A, D, G pattern in FIG. 8 displays the C major pentatonic scale. These two scales are separated by one half step.

A further improvement to this embodiment is possible by adding variations in shape, size, color, or design of the position markers. In one such embodiment, the position markers have the following shapes: each note B marked by a diamond shape, each note B marked by a square shape, each note A marked by a triangle shape, each note D marked by a semicircle shape, and each note G marked by a circle shape. With these further visual distinctions among position markers, this array of position markers makes the notes more uniquely identifiable which results in easier, faster note recognition. This specific embodiment is illustrated in FIG. 8.

Figure 8:
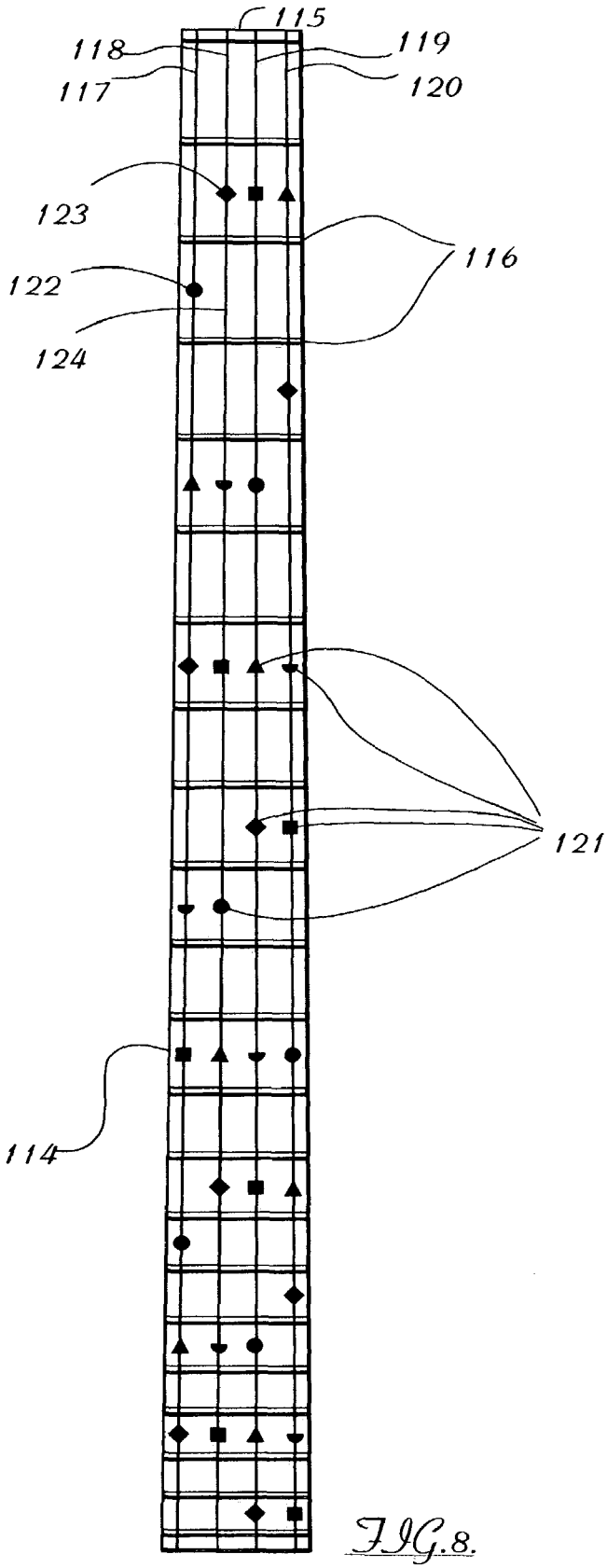
FIG. 8 is a top view of an array of fingerboard position markers for a bass guitar fingerboard, according to an embodiment of this invention.

FIG. 8 depicts a top view of an array of fingerboard position markers for a bass guitar fingerboard, according to an embodiment of this invention where the position markers are proximate the notes consisting of B, E, A, D, and G. The diagram shows a typical bass guitar fingerboard 114 with a nut 115, frets 116, and strings 117, 118, 119, and 120 tuned to standard open tuning notes E, A, D, and G, respectively, and position markers 121 of the specific embodiment. In viewing the diagram all the notes B are marked with diamond shaped position markers, all the notes E are marked with square shaped position markers, all the notes A are marked with triangle shaped position markers, all the notes D are marked with semicircle shaped position markers, all the notes G are marked with circle shaped position markers.

In viewing FIG. 8, the third fret-space on the E string is the note G, marked by a circle shaped position marker 122. The second fret-space on the A string is the note B marked by a diamond shaped position marker 123. The third fret-space 124 on the A string is the note C. Looking at the diamond shaped position marker 123, the note C is located one fret-space farther away from the nut. The same note C may also be referenced from the adjacent circle shaped position marker 122. All the note locations on the fingerboard can be readily recognized through use of the novel array of position markers of the present invention.

It has been shown herein above, that the piano key array corresponds to the F#/Gb major pentatonic scale, and the B, E, A, D, G array corresponds to the G major pentatonic scale. It follows that all major pentatonic scales may each define an array of position markers. Major pentatonic scale arrays are useful because they contain groups of three and groups of two position markers. The group of three consists of the first, second, and third tones of the scale. The group of two consists of the fourth and fifth tones of the scale.

Another preferred embodiment of the present invention is a stringed instrument apparatus wherein the position markers are proximate the notes consisting of B, E, A, D, G, C, and F. The orderly arrangement of the marks in this embodiment corresponds to all locations of the notes B, E, A, D, G, C, and F on the fingerboard. This array of position markers is particularly useful because the note intervals in fourths (i.e. the intervals from B to E, E to A, A to D, D to G, G to C and C to F), and fifths (i.e. the intervals from F to C, C to G, G to D, D to A, A to E, and E to B) are made readily apparent with this array of position markers. These intervals occur frequently in stringed instrument music and are useful to the musician. Also, this array of position markers is useful for a bass guitar, guitar, mandolin, violin, and cello because the notes B, E, A, D, G, and C can correspond to standard open string tuning notes for these instruments. By rearranging these notes as C, D, E, F, G, A, and B, it can be seen that these notes comprise the C major scale. The notes of the C major scale correspond to the white key notes of the piano key pattern. These notes are all unmarked in FIG. 5, and are all marked in FIG. 9. This C major scale array is useful because it marks the white key notes of the piano keyboard. It is, also useful because the unmarked notes correspond to the F#/Gb major pentatonic scale.

Figure 9:
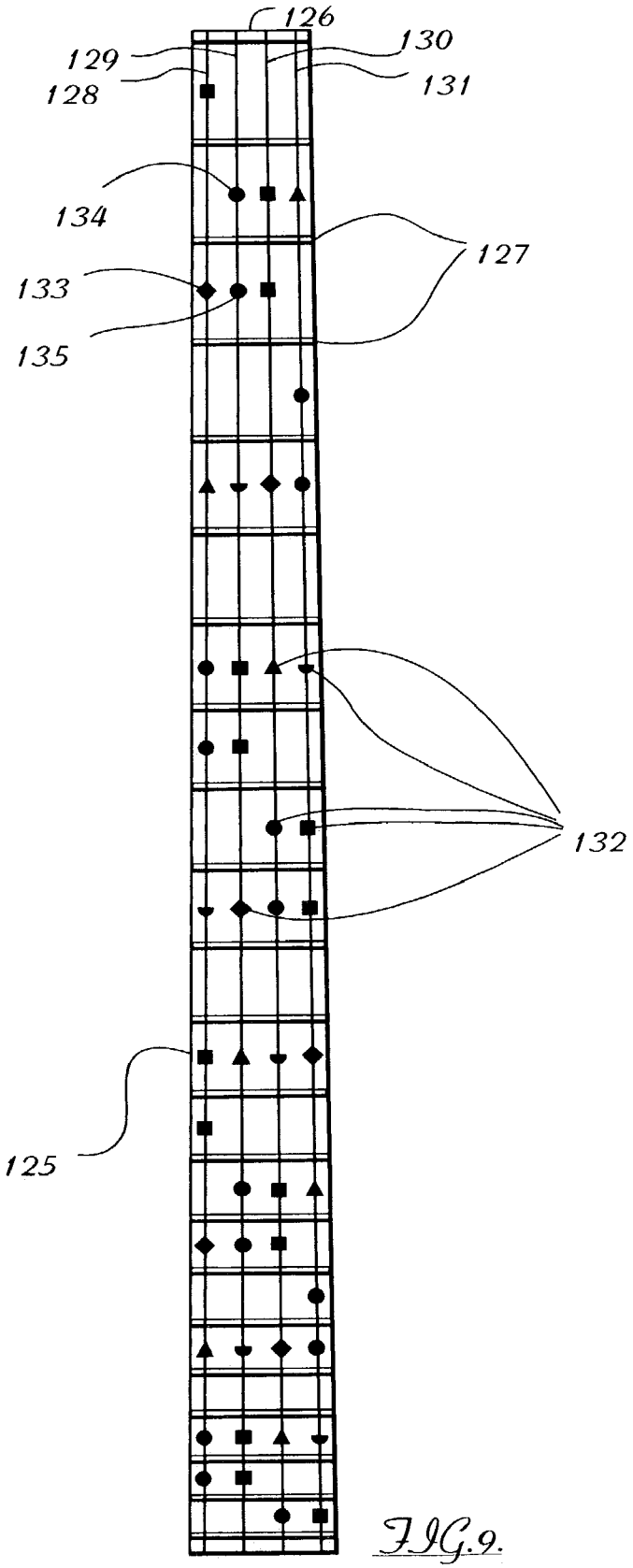
FIG. 9 is a top view of an array of fingerboard position markers for a bass guitar fingerboard, according to an embodiment of this invention.

A further improvement to this embodiment is possible by adding variations in shape, size, color, or design of the position markers. In one such embodiment, the position markers have the following shapes: each note C marked by a circle shape, each note D marked by a semicircle shape, each note E marked by a square shape, each note F marked by a square shape, each note G marked by a diamond shape, each note A marked by a triangle shape, and each note B marked by a circle shape. This specific embodiment is illustrated in FIG. 9. With these further distinctions among position markers, this array of position markers makes the notes more uniquely identifiable, which results in easier, faster note recognition. For the present invention, these variations in position marker characteristics can include any user discernable feature. These user discernable features can be the shape, size, color, or design of the position marker. The "design," as herein defined, may be any ornamental attribute that sets the position marker apart, or otherwise distinguishes it, from other position markers, as employed in the present invention.

FIG. 9 depicts a top view of an array of fingerboard position markers for a bass guitar fingerboard, according to an embodiment of this invention where the position markers are proximate the notes consisting of C, D, E, F, G, A, and B. The diagram shows a typical bass guitar fingerboard 125 with a nut 126, frets 127, and strings 128, 129, 130, and 131 tuned to standard open tuning notes E, A, D, and G, respectively, and position markers 132 of the specific embodiment. In viewing the diagram, all the notes B and C are marked with circle shaped position markers, all the notes D are marked with semicircle shaped position markers, all the notes E and F are marked with square shaped position markers, all the notes G are marked with diamond shaped position markers, and all the notes A are marked with triangle shaped position markers.

In viewing the diagram, the third fret-space on the B string is the note G, marked by a diamond shaped position marker 133. The second fret-space on the A string is the note B marked by a circle shaped position marker 134. The third fret-space on the A string is the note C marked by a circle shaped position marker 135. All the note locations on the fingerboard can be readily recognized through use of the novel array of position markers of the present invention.

Any major scale may define an array of position markers. The unmarked fret-space locations for each major scale array are the notes of a major pentatonic scale. These unmarked fret-space locations are useful because they contain groups of three and groups of two. The group of three consists of the first, second, and third tones of the major pentatonic scale. The group of two consists of the fourth and fifth tones of the major pentatonic scale.

Figure 10:
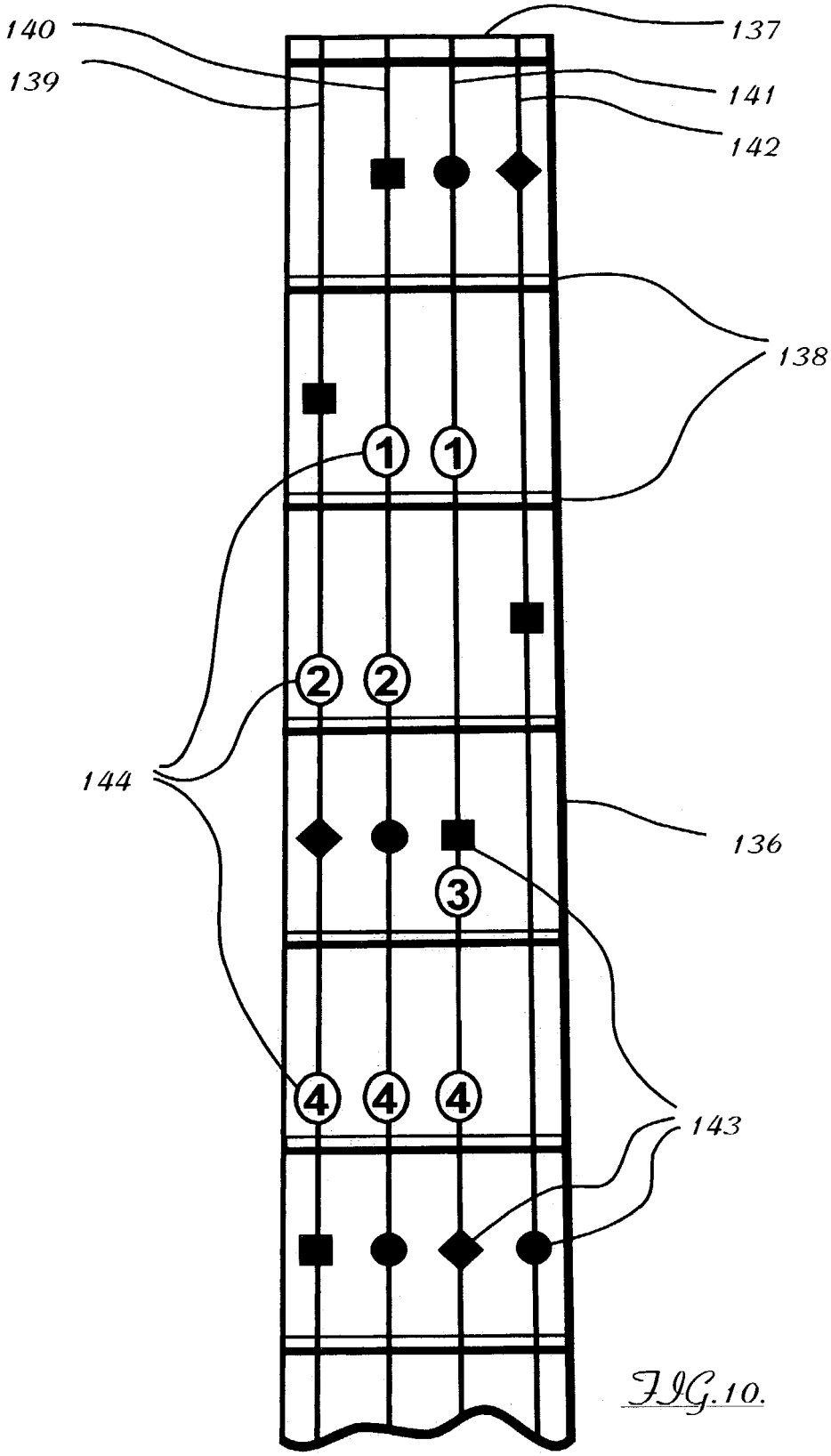
FIG. 10 is a top view of a reference diagram for a bass guitar, according t o an embodiment of this invention.

FIG. 10 depicts an example of the reference diagram tool embodiment of the present invention, showing a typical musical scale reference, diagram for a bass guitar as is commonly found in instructional or reference materials. The diagram shows a portion of a fingerboard 136 with a nut 137, frets 138, and strings 139, 140, 141, and 142 tuned to standard open tuning notes E, A, D, and G, respectively, and position markers 143 in the same manner as the preferred embodiment of the apparatus shown in FIG. 6. Standard fingering notations 144 show the correct finger (numbered 1 through 4), and location on the fingerboard to stop the string with the indicated finger. In this particular diagram the notations 144 are shown for playing a G major scale. Many different scales, notes, and chords could be indicated in diagram form along with the novel array of position markers in this reference diagram tool embodiment.

The present invention has utility for musicians at all playing abilities, from beginner to professional. In the case of beginning students of stringed instruments who do not read music and have little musical training, the present invention makes playing much more accessible and easier to learn than was previously possible. For example, with a piano key pattern array embodiment of the present invention, a beginning student could be shown how a piano keyboard has an easily recognized pattern of black and white keys. The student will notice that the pattern of position markers on the stringed instrument also repeats. All twelve notes of the chromatic scale can be quickly identified in relation to a piano key pattern of position markers. With this knowledge, the student will quickly discover where the same notes are repeated, both of the same pitch and of different octaves throughout the fingerboard. Next, it will be possible to play different series of notes, ascending or descending, connecting a starting note with an ending note an octave higher or lower. Such note series are precursors to scales. For those who can read music and/or recognize the piano keyboard notes, a piano key pattern array embodiment of the present invention offers the ability to learn and play music with dramatically increased ease over current methods.

A beginning student would typically learn a few starting notes, together with standard musical notation for the notes. Such notes can include C, D, E, F, G, etc., with one or two notes being introduced at a time. The present invention would indicate the note locations marked on the fingerboard, for example, according to the piano key pattern array or the B, B, A, D, G pattern array, or any other novel array of position markers. With this information, the student could play the notes at the correct location on the fingerboard, or at the octave of their choosing. The student could then progress to playing single note melodies and would have a better understanding for constructing chords and arpeggios. With the present invention it is much easier to recognize notes over the entire fingerboard range. With the conventional arrangement of position markers, students tend to restrict their playing to a limited area of the fingerboard.

For those who know a limited amount of music theory, one example of an improvement the present invention offers is that the proper position of bar chords can be readily recognized. This is accomplished by knowing the form, or relative fingering positions, for the bar chord, and referencing from fingerboard position markers of the present invention the location of the "tonic note" of the chord. The tonic note is also the letter name of the chord, for example the tonic of the A major chord is the note A. Thus, for the E position bar chord, a standard bar chord position played on the guitar, the tonic is indicated by the fret-space location of the first finger, or "barring finger," which is on the E strings. Therefore, to play a G chord using the E position bar chord, the user would form the chord with the first finger stopping the note G on both of the E strings.

Some players of stringed instruments play by ear or have practiced sufficiently to learn fingering patterns of locations to stop strings to create, various sounds or scales, without needing to know all notes being played in the scale. Most players of this type will know a few basic note locations on the instrument, and position their fingering pattern relative to the tonic note of the key being played. To play a D minor scale in relation to a novel array of position markers, they would position their minor scale fingering pattern relative to the known location of D, and select locations to stop strings according to this minor scale fingering pattern.

A player with this background could begin learning the actual notes being played much easier with the present invention. Once the notes indicated by the position markers of the present invention are learned, the locations where the fingering patterns are played will indicate to the player what notes are being played. With a piano key pattern array of the present invention, some simple scales can also be played immediately with the present invention. One is the C major scale. These notes correspond to the white keys of the piano keyboard, also shown as the marked fret-space locations of the specific embodiment of FIG. 9, and the unmarked fret-space locations of the specific embodiments of FIGS. 5, 6 and 7. Another is the F#/Gb major pentatonic scale. These notes correspond to the black keys of the piano keyboard, also shown as the unmarked fret-space locations of the specific embodiment of FIG. 9, and the marked fret-space locations of the specific embodiments of FIGS. 5, 6 and 7. With the B, E, A, D, G pattern array of the present invention, the notes of the G major pentatonic scale are easily recognized because they correspond to all the marked fret-space locations of the specific embodiment of FIG. 8.

The following example of a piano key pattern array demonstrates a possible use of the apparatus, as shown in FIG. 6. A bass guitar player, while following the chord progression of a song, will use the novel array of position markers to find the location of the tonic note of the chord. For example, when the user plays a bass line for the F chord, the user will look down at the fingerboard of the bass guitar and quickly recognize the group of three position markers, such as the square, diamond, and square, and upon recognizing these position markers, the user will know that all F notes are located at the next fret-space nearer to the nut from the group of these three position markers. The bass guitar player can then play a bass line which, may be a simple memorized fingering pattern starting at the tonic note F. The user will continue to use the novel array of position markers to locate the other tonic notes of the chords for the song, such as Bb and C, and may play the same simple memorized fingering pattern starting at each tonic.

In another example of a piano key pattern array, a mandolin player will use the novel array of position markers to find the locations of the notes to play while reading sheet music. For example, when the mandolin player sees the middle C note written on a piece of music, the user will look down at the fingerboard of the mandolin and quickly find the group of two circle shaped position markers, and upon seeing these position markers will use the knowledge that all C notes are located at the next fret-space nearer to the nut from the group of two circle shaped position markers. For a mandolin with the novel array of position markers that also distinguishes octaves (e.g. position markers as shown in one embodiment on a bass guitar in FIG. 7), the player will then find the position markers within the first octave, which are the notes with the lowest musical pitch on the instrument. The first octave contains the only middle C on a mandolin, located at the next fret-space nearer to the nut from the group of two circle shaped position markers within this octave. This same basic process can be used for all the notes that are on the mandolin and that are represented by musical notation. Many of the notes on the mandolin, as well as other stringed instruments, are found in more than one location on the fingerboard, even though they are the same notes within an octave. In these cases, the mandolin player must decide which note locations to use that suit the particular playing need.

For the preferred embodiment of the apparatus of the present invention shown in FIG. 8, a bass guitar exemplifies the B, E, A, D, G pattern array. A bass guitar player, while following the chord progression of a song, will use the novel array of position markers to find the location of the tonic note of the chord. For example, when bass guitar players play a bass line for the B chord, they will look down at the fingerboard of the bass guitar and quickly recognize the B note, which is marked with the diamond shaped position marker 123, the tonic of the B chord. Bass guitar players will continue to use the novel array of position markers to locate the other tonic notes of the chords for the song, such as the E note marked with the square shaped position marker, and such as the A note marked with the triangle shaped position marker.

For the preferred embodiment of the apparatus of the present invention shown in FIG. 9, a bass guitar exemplifies the C major scale array. A bass guitar player, while following the chord progression of a song, will use the novel array of position markers to find the location of the tonic note of the chord. For example, when bass guitar players play a bass line for the G chord, they will look down at the fingerboard of the bass guitar and quickly recognize the G note, which is marked with the diamond shaped position marker 133, the tonic of the G chord. Bass players will continue to use the novel array of position markers to locate the other tonic notes of the chords for the song, such as the D note marked with the semicircle shaped position marker, and such as the C note marked with the circle shaped position marker. The C note position marker 135 is located adjacent to the B note position marker 134. The C note position marker is always located one fret-space farther from the nut relative to the B note position marker, also a circle shaped position marker for the preferred embodiment shown in FIG. 9.

This same instruction as to relative note locations for mandolin and bass guitar can be just as easily applied to the guitar, banjo, violin, or other stringed instrument. For any stringed instrument properly marked according to any embodiments of the present invention and according to the instrument's tuning, the notes can be recognized uniquely from the novel array of position markers. This broad range of applications makes the present invention a powerful tool, where persons can more easily learn to play a variety of stringed instruments with different standard tunings, if they are marked according to the present invention.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

What is claimed is:

1. A stringed instrument fingerboard with position markers, which includes:

an array of fingerboard position markers, said array of fingerboard position markers comprising a component part of a fingerboard, said fingerboard comprising a component part of a stringed instrument;

each position marker of said array is positioned in a one-to-one correspondence with a string of the stringed instrument;

each position marker of said array of position markers is proximate to a specific note of a group of notes on the stringed instrument fingerboard, the group of notes consisting of C#/Db, D#/Eb, F#/Gb, G#/Ab, and A#/Bb;

the position marker for each note C#/Db is a first user discernable characteristic;

the position marker for each note D#/Eb is the first user discernable characteristic;

the position marker for each note F#/Gb is a second user discernable characteristic;

the position marker for each note G#/Ab is a third user discernable characteristic; and the position marker for each note A#/Bb is the second user discernable characteristic.

2. The stringed instrument fingerboard with position markers of claim 1, wherein at least one of the position markers of said array of position markers distinguishes at least an octave.

3. A stringed instrument fingerboard with position markers, which includes:

an array of fingerboard position markers, said array of fingerboard position markers comprising a component part of a fingerboard, said fingerboard comprising a component part of a stringed instrument;

each position marker of said array is positioned in a one-to-one correspondence with a string of the stringed instrument;

each position marker of said array of position markers is proximate to a specific note of a group of notes on the stringed instrument fingerboard, the group of notes consisting of B, E, A, D, and G;

the position marker for each note B is a first user discernable characteristic;

the position marker for each note E is a second user discernable characteristic;

the position marker for each note A is a third user discernable characteristic;

the position marker for each note D is a fourth user discernable characteristic; and the position marker for each note G is a fifth user discernable characteristic.

4. The stringed instrument fingerboard with position markers of claim 3, wherein at least one of the position markers of said array of position markers distinguishes at least an octave.

5. A stringed instrument fingerboard with position markers, which includes:

an array of fingerboard position markers, said array of fingerboard position markers comprising a component part of a fingerboard, said fingerboard comprising a component part of a stringed instrument;

each position marker of said array is positioned in a one-to-one correspondence with a string of the stringed instrument;

each position marker of said array of position markers is proximate to a specific note of a group of notes on the stringed instrument fingerboard, the group of notes consisting of C, D, E, F, G, A, and B;

the position marker for each note C is a first user discernable characteristic;

the position marker for each note D is a second user discernable characteristic;

the position marker for each note E is a third user discernable characteristic;

the position marker for each note F is the third user discernable characteristic;

the position marker for each note G is a fourth user discernable characteristic;

the position marker for each note A is a fifth user discernable characteristic; and the position marker for each note B is the first user discernable characteristic.

6. The stringed instrument fingerboard with position markers of claim 5, wherein at least one of the position markers of said array of position markers distinguishes at least an octave.

7. A stringed instrument fingerboard with position markers, which includes:

an array of fingerboard position markers, said array of fingerboard position markers comprising a component part of a fingerboard, said fingerboard comprising a component part of a stringed instrument;

each position marker of said array is positioned in a one-to-one correspondence with a string of the stringed instrument:

each position marker of said array is proximate to a specific note of a group of notes on the stringed instrument fingerboard, the group of notes consisting of any individual major pentatonic scale;

at least three of the position markers of said array have user discernable characteristics that are different from each other;

the position marker for the first note of an individual major pentatonic scale is a first user discernable characteristic;

the position marker for the second note of the individual major pentatonic scale is a second user discernable characteristic;

the position marker for the third note of the individual major pentatonic scale is a third user discernable characteristic;

the position marker for the fourth note of the individual major pentatonic scale is a fourth user discernable characteristic; and the position marker for the fifth note of the individual major pentatonic scale is a fifth user discernable characteristic.

8. The stringed instrument fingerboard with position markers of claim 7, wherein:

the group of notes consists of the G major pentatonic scale where the position marker for each note B is a first user discernable characteristic;

the position marker for each note E is a second user discernable characteristic;

the position marker for each note A is a third user discernable characteristic;

the position marker for each note D is a fourth user discernable characteristic; and the position marker for each note G is a fifth user discernable characteristic.

9. The stringed instrument fingerboard with position markers of claim 8, wherein:

the first user discernable characteristic is a diamond shape;

the second user discernable characteristic is a square shape;

the third user discernable characteristic is a triangle shape;

the fourth user discernable characteristic is a semicircle shape; and the fifth user discernable characteristic is a circle shape.

10. The stringed instrument fingerboard with position markers of claim 7, wherein:

the group of notes consists of the F#/Gb major pentatonic scale where the position marker for each note C#/Db is a first user discernable characteristic;

the position marker for each note D#/Eb is a second user discernable characteristic;

the position marker for each note F#/Gb is a third user discernable characteristic;

the position marker for each note G#/Ab is a fourth user discernable characteristic; and the position marker for each note A#/Bb is a fifth user discernable characteristic.

11. The stringed instrument fingerboard with position markers of claim 7, wherein:

the group of notes consists of the F#/Gb major pentatonic scale where the position marker for each note C#/Db is a first user discernable characteristic;

the position marker for each note D#/Eb is the first user discernable characteristic;

the position marker for each note F#/Gb is a second user discernable characteristic;

the position marker for each note G#/Ab is a third user discernable characteristic; and the position marker for each note A#/Bb is the second user discernable characteristic.

12. The stringed instrument fingerboard with position markers of claim 11, wherein:

the first user discernable characteristic is a circle shape;

the second user discernable characteristic is a square shape; and the third user discernable characteristic is a diamond shape.

13. A stringed instrument fingerboard with position markers, which includes:

an array of fingerboard position markers, said array of fingerboard position markers comprising a component part of a fingerboard, said fingerboard comprising a component part of a stringed instrument;

each position marker of said array is positioned in a one-to-one correspondence with a string of the stringed instrument;

each position marker of said array is proximate to a specific note of a group of notes on the stringed instrument fingerboard, the group of notes consisting of any individual major scale;

at least three of the position markers of said array have user discernable characteristics that are different from each other;

the position marker for the first note of an individual major scale is a first user discernable characteristic;

the position marker for the second note of the individual major scale is a second user discernable characteristic;

the position marker for the third note of the individual major scale is a third user discernable characteristic;

the position marker for the fourth note of the individual major scale is a fourth user discernable characteristic;

the position marker for the fifth note of the individual major scale is a fifth user discernable characteristic;

the position marker for the sixth note of the individual major scale is a sixth user discernable characteristic; and the position marker for the seventh note of the individual major scale is a seventh user discernable characteristic.

14. The stringed instrument fingerboard with position markers of claim 13, wherein:

the group of notes consists of the C major scale where the position marker for each note C is a first user discernable characteristic;

the position marker for each note D is a second user discernable characteristic;

the position marker for each note E is a third user discernable characteristic;

the position marker for each note F is the third user discernable characteristic;

the position marker for each note G is a fourth user discernable characteristic.

the position marker for each note A is a fifth user discernable characteristic; and the position marker for each note B is the first user discernable characteristic.

15. The stringed instrument fingerboard with position markers of claim 14, wherein:

the first user discernable characteristic is a circle shape;

the second user discernable characteristic is a semicircle shape;

the third user discernable characteristic is a square shape;

the fourth user discernable characteristic is a diamond shape; and the fifth user discernable characteristic is a triangle shape.

* * * * *

UNITED STATES PATENT AND TRADEMARK OFFICE

CERTIFICATE OF CORRECTION

PATENT NO. : 6,984,780 B2 
APPLICATION NO. : 10/625446
DATED : January 10, 2006
INVENTOR(S) : Timothy D. Reierson et al.

It is certified that error appears in the above-identified patent and that said Letters Patent is hereby corrected as shown below:

Title page,
Item [12], should read -- Reierson, et al. --.
Item [76], should read:
-- Inventors: Timothy D. Reierson, 6604 Appleview Rd., Yakima, WA (US) 98908
H. Nicholas Riddle, 2400 St. Hilaire Road, Moxee, WA (US) 98936 --; and Column 19,
Line 47, "B, B, A, D, G" should read -- B, E, A, D, G --.

Signed and Sealed this

Twenty-fifth Day of July, 2006

JON W. DUDAS
*Director of the United States Patent and Trademark Office*